United States Patent [19]

Salukvadze

[11] 3,959,862

[45] June 1, 1976

[54] ROTARY CUTTING TOOL

[76] Inventor: Viktor Samsonovich Salukvadze, 5 Parkovaya ulitsa, 42, kv. 53, Moscow, U.S.S.R.

[22] Filed: Aug. 5, 1975

[21] Appl. No.: 602,018

[30] Foreign Application Priority Data

Aug. 8, 1974 U.S.S.R. ..... 2052050

[52] U.S. Cl. ..... 29/105 R; 15/198

[51] Int. Cl.[2] ..... B23D 71/00; B26D 1/12

[58] Field of Search ..... 29/105 R, 81 H, 81 J; 15/198, 200

[56] References Cited

UNITED STATES PATENTS

| | | | |
|---|---|---|---|
| 1,372,680 | 3/1921 | Frost | 15/198 |
| 3,557,418 | 1/1971 | Salukvadze | 29/105 R |

*Primary Examiner*—Leonidas Vlachos
*Attorney, Agent, or Firm*—Haseltine, Lake & Waters

[57] ABSTRACT

The invention related to rotary cutting tools for working articles and materials.

The disclosed tool has cutting members having their portions adjoining the secured ends of the members received in a sleeve, the free ends of these members being bent radially and urged by a washer against the end face of the sleeve, the cutting effort at the end faces of the bent free ends being determined by the sum of the bending and twisting strain created in the portions of the cutting members, the width of the cutting surface of the tool for one set of the cutting members being determined from the expression:

$$B = \frac{(D_1^2 - D_2^2)\phi_1}{2D\phi}$$

where

D is the diameter of the cutting surface of the tool;

B is the width of the cutting surface;

$D_1$ is the external diameter of the set of the cutting members, received in the sleeve;

$D_2$ is the internal diameter of the set of the cutting members, received in the sleeve;

$\phi$ is the ratio of the sum of the areas of the end faces of the free ends of the cutting members in the cutting surface of the tool to the entire area of the cutting surface;

$\phi_1$ is the ratio of the sum of the areas of the secured ends of the cutting members to the entire area of the internal surface of the sleeve.

1 Claim, 4 Drawing Figures

ROTARY CUTTING TOOL

The invention relates to cutting tools and, more particularly, it relates to rotary cutting tools for working the surfaces of articles and materials.

The invention can be employed to utmost effectiveness for removing scale off the surface of hot-rolled metal, for cleaning the surface of rolled shapes and for removing the defective layer therefrom, for removing the surface layer off castings and off the internal surface of pipes and tubes of a relatively small diameter, for cleaning the surface of metal articles from rust, grease, etc.

At present, there are employed various techniques and tools for working and cleaning the curvilinear surfaces of metals and other materials, such as:

abrasive wheels and bands;
rotary milling cutters;
cutting heads of skimming lathes;
cutting heads in planing and skimming machines.

The technique most commonly used nowadays for working and skimming the curvilinear surfaces of articles and materials is the one of skimming with abrasion tools, either with aid of mechanised hand tools or in stationary machines.

However, abrasive wheels and bands are not durable and display a tendency to get "greased" when used for working viscous or tough materials and to produce "burnt" areas in the surfaces being worked.

Operations of skimming curvilinear surfaces with abrasive tools are both labor-consuming and costly, while the poor durability of the tools presents abstacles in introducing automation into these operations.

Besides, the technique of skimming with abrasives cannot be used with sufficient productivity for working titanium and its alloys, the same as several non-ferrous metals, e.g. copper, aluminum and others.

Furthermore, abrasive tools in operation pollute the ambient atmosphere with abrasive dust.

Another known technique of working and skimming the curvilinear surfaces of articles is the one milling in various milling machines.

At present, there is being ever wider introduced the method of cleaning and skimming curvilinear surfaces with a rotary cutting tool of the rotary wire brush type, which is due to the fact that these tools offer fine cutting properties and are easy to operate.

Among the tools of the last-mentioned type there is a rotary cutting tool for working the surfaces of articles and materials, including a plurality of radially extending resilient cutting members, e.g. in the form of pieces of wire, having their one ends secured together and having their portions adjoining these secured ends pressed to one another by their side surfaces, the opposite free ends of the cutting members defining the cutting surface of the tool shaped as a surface of rotation, the ratio of the sum total of the areas of the end faces of the free ends of the cutting members in the cutting surface of the tool to the entire area of this cutting surface being within a range from 0.10 to 0.99 (see, for example, the U.S. Pat. No. 3,557,418, Class 29–105).

Although possessing fine cutting properties, these tools, however, display a tendency of breaking and losing their cutting members, when the tools are some 80 mm and less in diameter. This is explained by the fact that in the above-described wire brush cutting tools of the prior art the length of the cutting members depends on the diameter of the tool. Moreover, the length of the cutting members is determined with provisions for the strength of their material. With the diameter of the brush type rotary cutter of the prior art being short of 80 mm, the length of the cutting members becomes less than the calculated optimal value, which affects the strength and durability of the tool. Besides, the relatively small length of the cutting members complicates to a great extent the problem of welding together their non-working ends without annealing their free ends, which is not tolerated.

It is an object of the present invention to create a rotary cutting tool for working the surfaces of articles and materials, wherein the resilient cutting members should be of a structure providing for making the tools of small diameters, e.g. short of 80 mm.

It is an important object of the present invention to create a tool of the abovedescribed type, which should possess fine cutting properties.

It is another object of the present invention to create a rotary cutting tool of the abovedescribed type, which should have durable cutting properties.

It is still another object of the present invention to create a tool of the abovedescribed type, which should be simple and convenient in operation.

It is yet another object of the present invention to create a tool of the abovedescribed type, which should provide for a simple operation of working the surfaces of articles.

These and other objects are attained in a rotary cutting tool including a mandrel with resilient cutting members radially supported thereon, e.g. in the form of pieces of wire having substantially equal lengths, the members having their one ends secured together and having their portions adjoining said secured ends pressed against one another by their side surfaces, the opposite free ends of the cutting members defining the cutting surface of the tool, shaped as a surface of rotation, the ratio of the sum total of the areas of the end faces of the free ends of these cutting members in the cutting surface of the tool to the entire area of this surface being within a range from 0.10 to 0.99, in which tool, according to the invention, the portions of the cutting members, adjoining their secured ends, are received within a sleeve, the free ends of these cutting members being bent radially and urged against the end face of this sleeve by a washer, the cutting effort at the end faces of the bent cutting members being determined by the sum of the bending and twisting strain created in the portions of the cutting members, the width of the cutting surface of the tool for one set of the cutting members being determined from the expression:

$$B = \frac{(D_1^2 - D_2^2)\phi_1}{2D\phi}$$

where

D is the diameter of the cutting surface of the tool;
B is the width of the cutting surface of the tool;
$D_1$ is the external diameter of the set of the cutting members, received in the sleeve;
$D_2$ is the internal diameter of the set of the cutting members, received in the sleeve;
$\phi$ is the ratio of the sum total of the areas of the end faces of the free ends of the cutting members in the cutting surface of the tool to the entire area of this cutting surface;

$\phi_1$ is the ratio of the sum total of the areas of the secured ends of the cutting members to the entire area of the internal surface of the sleeve.

The herein disclosed structure enables to manufacture tools of small diameters, short of 80 mm, since with the free ends of the cutting members being bent radially, the members acquire two portions, one portion being defined by the radially bent free ends and the other portion being defined by the secured together non-working ends accommodated within the sleeve. Consequently, the total length of each cutting member is made up by the lengths of the two portions. Therefore, by increasing the length of the second portion, i.e. the length of the secured together non-working ends portions of the cutting member, we are able to reduce correspondingly the length of the first-mentioned portion, i.e. the length of the free ends of the cutting members, and this to have a cutting tool of a diameter as small as we need.

The present invention will be better understood from the following detailed description of an embodiment thereof, with reference being had to the appended drawings, wherein.

Figure 1:
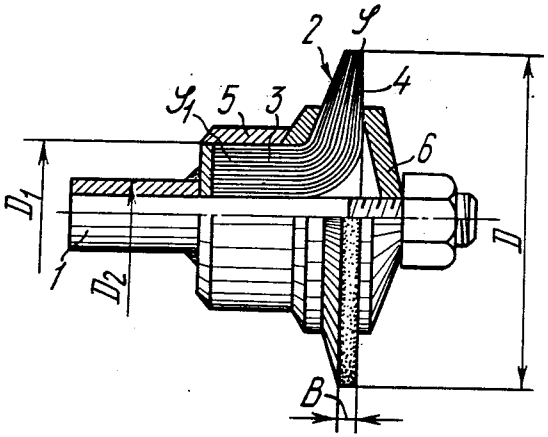
FIG. 1 is a partly sectional view of the disclosed rotary cutting tool.
Figure 2:
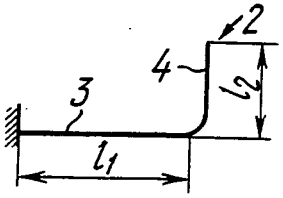
FIG. 2 is a schematic presentation of the cutting member with the bent free end.

Referring now to the appended drawings, the herein disclosed rotary cutting tool includes a mandrel 1 (FIG. 1) supporting thereon radially extending resilient cutting members 2 in the form of pieces of wire of the same length. The cutting members 2 have each two portions 3 and 4 of which the portion 3 is defined by the ends of the cutting members, which are secured together, the cutting members in the vicinity of these secured ends being pressed to one another by their side surfaces and accommodated within a sleeve 5. The portion 4 is defined by the free ends of the cutting members 2, which are bent radially of the mandrel 1 and urged by a washer 6 against the end face of the sleeve 5. The lengths of the portions 3 and 4 of the cutting members 2 are, respectively, $l_1$ and $l_2$ (FIG. 2), and the total length of each cuttng member is the sum of these two lengths. Therefore, without varying the total length of the cutting member, it is possible to reduce the length $l_2$ by increasing correpondingly the length $l_1$, i.e. to have the working diameter of the cutting tool as small as required.

This has been made possible by the diameter of the working surface of the disclosed tool being defined by the double length $l_2$ of the second portion 4, whereas in the cutting tools of the prior art this diameter is defined by the double length of the entire cutting member 2.

The end faces of the radially bent free ends of the cutting members 2 define the cutting surface of the tool, shaped as a surface of rotation, the ratio of the sum total of the areas of these end faces in the cutting surface of the tool to the entire area of this surface being from 0.10 to 0.99.

The cutting effort at the end faces of the bent free ends of the cutting members 2 is determined by the sum of the bending and twisting strain developed, respectively, in the portions 4 and 3 of the cutting members 2.

The width B (FIG. 1) of the cutting surface of the tool for one set of the cutting members is determined from the expression:

$$B = \frac{(D_1^2 - D_2^2)\phi_1}{2D\phi}$$

where

D is the diameter of the cutting surface of the tool;

$D_1$ is the external diameter of the set of the cutting members 2 received in the sleeve 5, i.e. the internal diameter of this sleeve;

$D_2$ is the internal diameter of the set of the cutting members 2 received in the sleeve 5, i.e. the external diameter of the mandrel 1;

$\phi$ is the ratio of the sum total of the areas of the end faces of the wire in the cutting surface of the tool to the entire area of the cutting surface;

$\phi_1$ is the ratio of the sum total of the secured ends of the wire pieces to the entire area of the internal surface of the sleeve 5.

Figure 3:
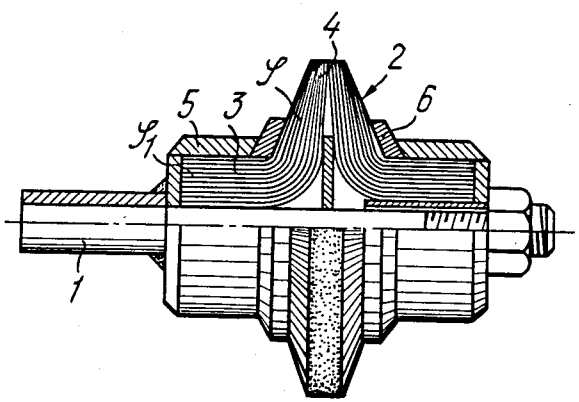
FIG. 3 is a partly sectional view of a modification of the disclosed rotary cutting tool.
Figure 4:
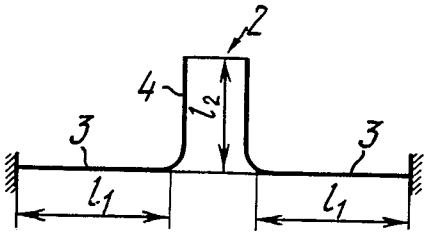
FIG. 4 is a schematic presentation of the cutting member of the modification shown in FIG. 3.

FIGS. 3 and 4 of the appended drawings show a modification of the disclosed rotary cutting tool. In this modification the tool contains two sets of the cutting members 2, one set to one side of the radial axis of symmetry of the tool. Each set has a structure similar to the one described hereinabove, the bent free ends of the cutting members being urged on both sides by the single washer 6, while the secured ends of these members are accommodated within the respective sleeves 5.

EXAMPLE

Let us presume that we require a rotary cutting tool of the disclosed type for working the internal surface of a pipe 60 mm in diameter. For the sake of the effectiveness of the working operation the diameter D of the tool should be smaller than the internal diameter of the pipe; therefore, let this diameter be 50 mm (D = 50 mm). The factors $\phi$ and $\phi_1$ will be, respectively, $\phi = 0.6$ and $\phi_1 = 0.9$.

To provide for removal of the waste material from the pipe being internally worked, let us have the external diameter of the set of the cutting members, received in the sleeve, i.e. the internal diameter $D_1$ of the sleeve equalling 40 mm ($D_1 = 40$ mm). Also let us have the internal diameter of the set of the cutting members, received in the sleeve, i.e. the external diameter $D_2$ of the mandrel equalling 10 mm ($D_2 = 10$ mm.

Then, according to the invention, the width B of the cutting surface of the tool is determined from the expression:

$$B = \frac{(D_1^2 - D_2^2)\phi_1}{2D\phi}.$$

By introducing the above values into this expression, we obtain the width B = 22.5 mm.

What is claimed is:

1. A rotary cutting tool for working the surfaces of articles and materials, comprising: a mandrel; a plurality of resilient cutting members in the form of pieces of wire having substantially equal lengths, radially arranged on said mandrel, said resilient cutting members being secured together with their one ends adjoining which said cutting members have their side surfaces pressed to one another; the free ends of said resilient cutting members, opposite to said secured ends, defining the common cutting surface of the tool, shaped as a surface of rotation; the ratio of the sum total of the areas of the end faces of said free ends of said pieces of wire in the cutting surface of the tool to the entire area of said cutting surface being within a range from 0.10 to 0.99; a sleeve received about said mandrel; the portions of said resilient cutting members, adjoining the said secured ends thereof, being received within said sleeve; said free ends of said cutting members being bent in a radial direction and urged by a washer against the end face of said sleeve; the cutting effort at the end faces of said bent free ends of said cutting members being determined by the sum of the bending and twisting strain developed in the portions of said cutting members, the width of the cutting surface of the tool for one set of said resilient cutting members being determined from the expression:

$$B = \frac{(D_1^2 - D_2^2)\phi_1}{2D\phi},$$

where

D is the diameter of the cutting surface of the tool;

B is the width of the cutting surface of the tool;

$D_1$ is the external diameter of the set of said cutting members received in said sleeve;

$D_2$ is the internal diameter of the set of said cutting members, received in said sleeve;

$\phi$ is the ratio of the sum total of the areas of the end faces of the free ends of said cutting members in said cutting surface of the tool to the entire srea of said cutting surface;

$\phi_1$ is the ratio of the sum total of the areas of the secured ends of said cutting members to the entire area of the internal surface of said sleeve.

* * * * *